United States Patent [19]

Kroenke

[11] 4,158,265

[45] Jun. 19, 1979

[54] UNIVERSAL PRESSING HAM SUPPORT

[76] Inventor: June E. Kroenke, 509 Oakwood Dr., Hartland, Wis. 53029

[21] Appl. No.: 875,517

[22] Filed: Feb. 6, 1978

[51] Int. Cl.[2] ..... D06F 81/00; D06F 81/06

[52] U.S. Cl. ..... 38/135; 38/136; 223/57

[58] Field of Search ..... 38/103, 104, 135, 136, 38/137, 138, 139, 140, 141; 223/52, 52.1, 52.5, 57, 66, 73

[56] References Cited

U.S. PATENT DOCUMENTS

| | | | |
|---|---|---|---|
| 347,853 | 8/1886 | Whitman | 38/135 X |
| 1,614,043 | 1/1927 | Rehfeldt | 38/103 |
| 2,261,894 | 11/1941 | Zammitti | 38/137 X |
| 2,314,498 | 3/1943 | Hoagland | 38/140 X |
| 2,663,958 | 12/1953 | Keasl | 38/140 X |
| 2,826,668 | 3/1958 | Haynes et al. | 38/104 X |
| 3,052,389 | 9/1962 | Mutolese | 223/57 |
| 3,229,393 | 1/1966 | Kroenke | 38/135 |
| 3,653,135 | 4/1972 | Jones | 38/135 |

*Primary Examiner*—Louis Rimrodt

*Attorney, Agent, or Firm*—Andrus, Sceales, Starke & Sawall

[57] ABSTRACT

A universal pressing ham support holds various pressing hams in various positions with a desired exposed pressing surface. A unitary formed support includes sidewalls having a central opening. The top edge of opposite sidewalls are provided with offset recesses, varying slightly in width which permit laying of the pressing ham on its shallow sidewalls. Opposite sidewalls have second recesses, with the width of one being substantially larger than the other for supporting the ham with the large sidewall exposed. The central opening supports the pressing hams on end. The inner vertical walls are specially stepped and shaped to locate the pressing hams in an essentially upright position with the desired end of the ham exposed for pressing.

8 Claims, 9 Drawing Figures

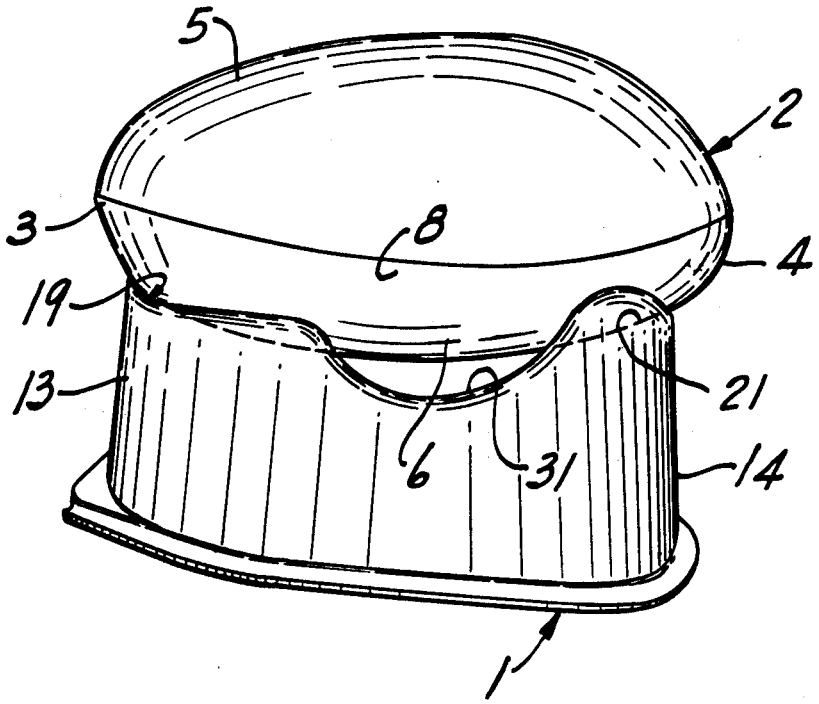

UNIVERSAL PRESSING HAM SUPPORT

BACKGROUND OF THE INVENTION

This invention relates to a universal pressing ham support for supporting of a pressing ham in any one of a plurality of positions for exposing of selected pressing surfaces.

In tailoring, various areas and portions of a garment may require special contouring so as to conform to a body contour and establish a well made, aesthetically pleasing finished garment. An accessory known as a pressing ham is widely employed to establish a cushioned smoothly curved pressing and shaping surface for supporting of the garment during the pressing of the shaped area, with a conventional manually manipulated iron, such as darts. Generally, the pressing ham is formed of a ham or egg-like configuration to define a relatively large curved end connected by slightly curved large sidewall surfaces and similar shallow sidewalls to a small curved end. An alternative ham which provides additional shaping surfaces includes a slight bend in the ham unit between the oppoiste ends to define convex and concave shallow sidewalls. The curved ham tapers down to a relatively blunt pointed end.

The use of such pressing hams requires a fair amount of dexterity and skill and are relatively time consuming. Thus, generally, one hand must operate the iron while another hand is supporting the ham and also smoothing the fabric over the ham. In actual operation, the operator normally supports the ham while smoothing the fabric thereon. Then the operator picks up the iron and assuming that the fabric maintains its proper positioning, presses the garment on the cushioned surface of the ham.

SUMMARY OF THE PRESENT INVENTION

The present invention is particularly directed to a universal support for supporting all of the various pressing hams in various positions with a desired exposed pressing surface. Thus, the support holds the ham in a generally upright position to expose the one appropriate surface, including either end, any of the sidewalls or tilted at a desired angle to expose an intermediate surface. Generally, in accordance with the teaching of the present invention, a unitary structural support includes four sidewalls enclosing a central opening. The top edge of two opposite sidewalls are provided with offset recesses or depressions, varying slightly in width. The recesses permit laying of the pressing ham on its shallow sidewalls. The adjacent opposite sidewalls are similarly formed with second depressions or recesses, with the width of one being substantially larger than the other. The second recesses define a support for the ham with the large sidewall exposed. The central portion of the support defines an opening for supporting the pressing ham on end. In a preferred and particularly unique construction, the universal support is a formed plastic unit with an enclosing triangular wall structure defining the opening. The vertical walls are preferably of a stepped construction adjacent the apex wall and the opposed base wall. The stepped construction defines internal supporting walls for either ham end, of either the flat or curved ham, within the support to locate the pressing ham in an essentially upright position with the desired end of the ham exposed for pressing. Thus, with the specially shaped inner supporting wall structure the conventional tear drop shaped pressing ham or the curved pressing ham can be supported in an upright position. The curved ham can particularly be more firmly located with the curved portion within the offset central portion or angularly oriented and resting on the opposite specially shaped curved side walls to expose the desired portions of the ham.

The present invention thus provides a highly useful pressing ham support for tailoring of garments where the cushioned pressing ham is needed or desired for proper shaping and pressing.

BRIEF DESCRIPTION OF DRAWING

The drawing furnished herewith illustrates a preferred construction of the present invention in which the above advantages and features are clearly disclosed as well as others which will be readily understood from the following description.

In the drawing.

DESCRIPTION OF THE ILLUSTRATED EMBODIMENT

Figure 1:
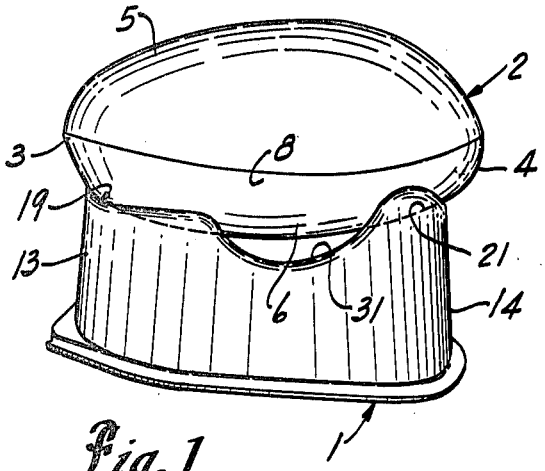
FIG. 1 is a side elevational view of a ham holder showing a conventional pressing ham in position.
Figure 2:
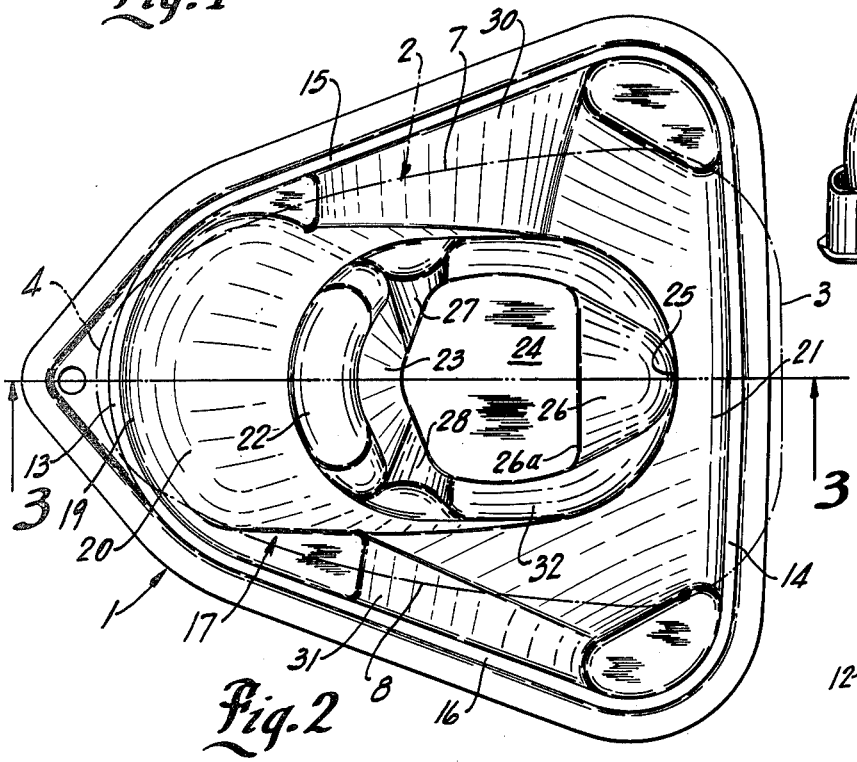
FIG. 2 is a plan view with the ham removed.
Figure 3:
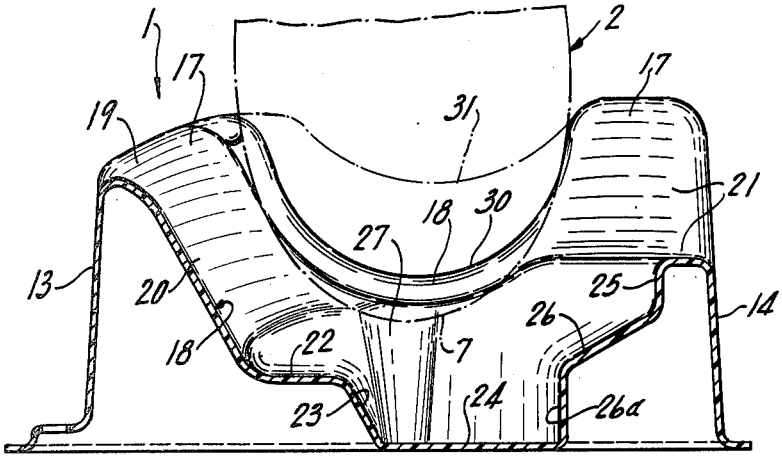
FIG. 3 is a vertical section through the holder taken on line 3—3 of FIG. 2.

Referring to the drawing and particularly to FIGS. 1–3, the illustrated embodiment of the invention is shown as an integrated universal support 1 for a pressing ham 2. The support 1 is adapted to support ham 2. The support 1 is adapted to support the pressing ham 2 with any portion of the cushioning curved pressing and shaping surface exposed above the support 1 to properly press an area of a garment, not shown. The illustrated ham 2 in FIG. 1 is a conventional tear-drop shaped ham having an elliptical cross section defining a relatively large slightly curved end 3, and a small, curved opposite second end 4. The shaped curved ends 3 and 4 are joined by a relatively large top and bottom surfaces or sidewalls 5 and 6 as well as relatively narrow surfaces or sidewalls 7 and 8. A curved pressing ham 9 is shown in a support 1 (FIGS. 4–8) and is generally similar in construction except that the curved construction defines a convex narrow sidewall 10 and a concave narrow sidewall 11. Also, the small end 12 is more pointed than that of ham 2. The pressing ham is normally formed of a sawdust, polyurethane foam or similar material and is covered with a suitable fabric. In use, any one of the several ends or sidewall surfaces may be used depending upon the particular area of the garment to be shaped and pressed. Support 1 is uniquely constructed to permit such orientation of the pressing ham. The support 1 is a generally triangular shaped member in which the vertical sidewalls include a blunted apex 13 which is opposite a base wall 14 and joined by sidewalls 15 and 16. The support 1 includes an enclosing top wall 17 connected to an inner sidewall 18 defining an opening for supporting of pressing ham 1 on end.

The apex 13 includes an upper edge or wall which is formed with a slight or shallow recess 19. The recess 19 has a slight downward taper to an inner intermediate vertical wall portion 20. The recess 19 is curved generally to conform to the sidewall 5 or 6 adjacent the narrower end 4. The opposite top edge of the base wall 14 is located slightly below that of the apex 13 is formed with concave recess 21 which conforms to the large flat end 3 of a pressing ham 2. The depth of the recess 21 is less than half that of the pressing ham 2 which may therefore be located with the one large wall 5 or 6 laying on the ham support and the opposed surface 5 or 6 exposed. The wall portion 20 extends downwardly to an intermediate ledge 22 which extends inwardly within the central opening. An inner wall 23 extends downwardly from the ledge 22 to the bottom of the support, which in the illustrated embodiment includes a flat bottom wall 24.

Figure 6:
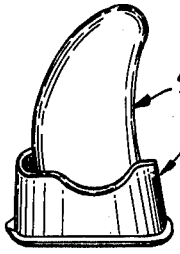

The upper edge of the base wall 14 is also relatively substantial and projects inwardly a short distance where it merges with a vertical intermediate wall 25 which extends downwardly to an intermediate ledge 26 generally aligned with the ledge 22 of the apex portion 13. Thus, the two ledges 22 and 25 cooperate to define an intermediate upright support accomodating the large end 3 of a pressing ham 2 or 9, of either the conventional or curved construction (FIG. 6).

The intermediate ledge 26 of the base wall 14 terminates inwardly in a vertical wall **26*a* which extends downwardly to the bottom wall 24 in the illustrated embodiment. The innermost vertical walls define a reduced opening which generally accomodates the very narrow end 12 of the curved pressing ham 9. The lower vertical wall 23 of the apex portion 13 is slightly curved and inclined and further merges with inward projecting curved wall portions 27 and 28 to the opposite sides thereof. The width of the lower wall 23 in the apex portion is therefore provided with a somewhat reduced vertical opening from the intermediate ledge 22 downwardly. The curved pressing ham 9 may be located with the narrow end 12 in the bottom-most opening and with the convex side 10 abutting the intermediate wall 25 and the lower end 12 abutting the curved reduced opening to intermediate wall 23** to create a firm, stable support therefore.

The opposite connecting side walls of the support also include top edges or top walls provided with concave recesses 30 and 31. The one sidewall recess 31 is formed as a relatively, shallow concave shape with the surface inclined downwardly and inwardly to an inner vertical wall 32. The opposite sidewall is formed with a substantially deeper recess 30, generally down to the level of the base wall recess 21 and of a substantially longer width. The recess surface extends inwardly to the vertical wall to define the lateral confines of the central opening. The curvature and offset orientation of the two sidewall recesses 30 and 31 are generally related to the offset created by the tapered curved configuration and width of the narrow sidewalls 7 and 8, a conventional pressing ham 2 or sidewalls 10 and 11 of the curved ham 9. Thus, either the conventional or the tapered pressing ham can be conveniently located on its side within the sidewall recesses 30 and 31.

Figure 4:
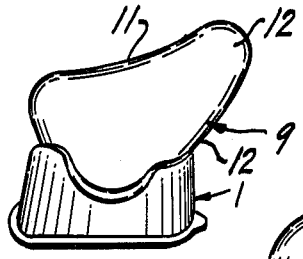
FIGS. 4–9 illustrate the support with the two forms of pressing hams presently employed in the tailoring of garments.
Figure 5:
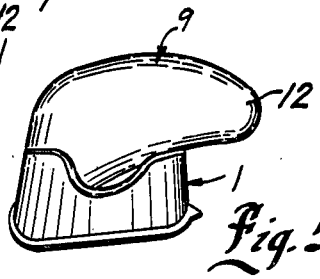
Figure 7:
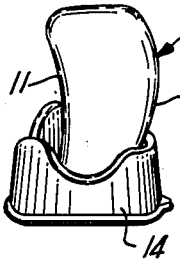
Figure 8:
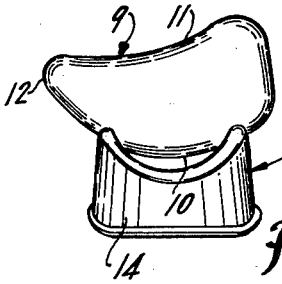
Figure 9:
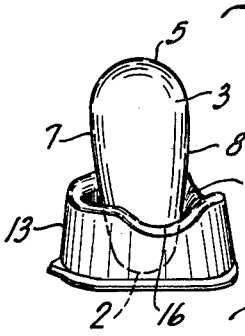

The ham 9 may be tilted slightly to expose the shaping surface to one side of the center plane through walls 10 and 11, as in FIGS. 4 and 5. The ham may be held in an upright position as shown in FIGS. 6, 7, and 9. The concave wall 11 or convex wall 10 may be exposed by placing of the ham 9 located within the lateral recesses 19 and 21 as shown in FIG. 8.

Thus, the illustrated embodiment of the invention provides a universal support for a pressing ham which securely and firmly supports the pressing ham in the desired position with the opposite ham surface exposed. The support thus frees the operator to use one hand for effective smoothing and locating the fabric on the pressing ham while using the other hand to handle the pressing device upon the pressing ham.

The support holds either pressing ham in essentially every usable position including an upright end position, lying flat on either sidewall, or tilted at any appropriate angle. As a result, the operator or tailor may without any difficulty expose and employ whatever surface area of the pressing ham is needed for the desired shaping and pressing requirement. Consequently, a garment can more appropriately to conformed to a body contour with a resulting aesthetically pleasing appearance of the finished garment.

The drawings furnished illustrate the best mode presently contemplated for carrying out the invention. However, various modifications and revisions can be made within the scope of this invention. For example, the holder may be formed of any suitable material and including individual components suitably connected to define the various sized openings or recesses for supporting of the pressing hams in any of the necessary positions and orientations. For example, a satisfactory support has been made and used including four vertical sidewalls of wood boards having the opposite sidewalls differently spaced to define openings to support the opposite ends of the pressing hams, and the upper edges suitably shaped to define the spaced supporting depressions or recessed for the pressing ham located on any of its four sides. Various modes of carrying out the invention are contemplated as being within the scope of the following claims, particularly pointed out and distinctly claiming the subject matter which is regarded as the invention.

I claim:

1. In a universal support for a pressing ham accessory adapted to support apparatus either of an egg-shaped pressing ham or a curved pressing ham, said support having first and second opposed end walls and opposed sidewalls, said end walls having upper recesses of different curvature and selected to support the pressing ham, said sidewalls having similar recesses of different depth and configuration to correspondingly accomodate opposite different surfaces of said pressing ham for supporting of the opposed surfaces of the ham in raised exposed relationship, said end walls and sidewalls defining a central opening within which the pressing ham can be located and supported in a vertical upright position, the distance between said end walls and said sidewalls being constructed and located to provide different openings for the tear-drop pressing ham and the curved pressing ham.

2. The support apparatus of claim 1 wherein the end walls are spaced to accomodate the large end of a pressing ham and the sidewalls are spaced to accommodate the small end of a pressing ham.

3. The support apparatus of claim 1 wherein said end walls and sidewalls are integrally molded as a single continuous element and including top walls which are inclined inwardly generally in accordance with the curvature of the portions of pressing hams adapted to be placed thereon.

4. The support apparatus of claim 1 having first and second intermediate ledges provided within said central opening defined by the end and sidewalls and located inwardly of and centrally of the end recesses of the end walls, said one ledge including a relatively flat horizontal portion, with an adjacent curved side wall portion defining a curved opening particularly related to the relatively narrow end of a curved pressing ham, the opposite ledge being a relatively small ledge of an inclined configuration and having an adjacent curved side wall portion, said ledges defining a horizontal support with supporting sidewalls adapted to support the large end of an egg-shaped pressing ham and the large end of a curved pressing ham.

5. The support apparatus of claim 4 wherein the bottom portion of said opening includes a curved end wall defining a restricted opening against the adjacent first ledge and a generally vertical wall adjacent the second ledge and being joined by generally curved side walls, said bottom opening being adapted to support the narrow end of a curved ham with the concave portion abutting said vertical wall and the convex portion abutting the end wall and resting within the restricted opening.

6. In the support of claim 5 wherein said element is molded as a single continuous integral plastic member having said several surfaces interconnected into each other.

7. An accessory support apparatus for a pressing ham to define a cushion pressing and shaping surface for tailoring comprising a support structure having at least first and second end walls and interconnecting side walls, the first end wall having a shallow concave recess with the upper wall extending inwardly and downwardly, the second end wall having a substantially deeper and wider concave recess with the upper wall extending inwardly with a slight incline relative to the degree of incline of the first end recess, said end opening recesses defining a support generally configured to conform to the configured surfaces of the opposite end portions of the sidewalls of the egg-shaped pressing ham, first and second intermediate ledges provided within the central opening of the support and located inwardly of and centrally of the end recesses of the end walls, the first ledge being aligned with the first end wall and located substantially below the center of the support, said first ledge including a relatively flat horizontal portion, with an adjacent curved side wall portion defining a curved opening particularly related to the relatively narrow end of a curved pressing ham, the opposite ledge being a relatively small ledge of an inclined configuration and having an adjacent curved sidewall portion, said ledges defining a horizontal support with supporting sidewalls adapted to support the large end of an egg-shaped pressing ham and the large end of a curved pressing ham, said support further having an innermost bottom opening with an inclined and curved sidewall defining a restricted opening against the adjacent first ledge and a generally vertical wall adjacent the second ledge and being joined by generally curved side walls, said bottom opening being adapted to support the narrow end of a curved ham with the concave portion abutting said vertical wall and the convex wall abutting the curved sidewall and resting within the restricted opening.

8. In the support of claim 7 wherein said element is molded as a single continuous integral plastic member having said several surfaces interconnected into each other.

* * * * *

UNITED STATES PATENT AND TRADEMARK OFFICE

CERTIFICATE OF CORRECTION

PATENT NO. : 4,158, 265 SHEET 1 OF 2

DATED : June 19, 1979

INVENTOR(S) : JUNE E. KROENKE

It is certified that error appears in the above-identified patent and that said Letters Patent are hereby corrected as shown below:

| | |
|---|---|
| Column 2, Line 42 | After "by" cancel "a"; |
| Column 2, Line 68 | Before "located" cancel "is"; |
| Column 4, Line 11 | Before "conformed" cancel "to" and substitute therefore --- be ---; |
| Column 4, Line 31 | Before "out" cancel "pointed" and substitute therefore --- pointing ---; |
| Column 4, Line 35<br>CLAIM 1 | After "support" insert --- apparatus ---; |

UNITED STATES PATENT AND TRADEMARK OFFICE

CERTIFICATE OF CORRECTION

SHEET 2 OF 2

PATENT NO. : 4,158,265

DATED : June 19, 1979

INVENTOR(S) : JUNE E. KROENKE

It is certified that error appears in the above-identified patent and that said Letters Patent are hereby corrected as shown below:

| | |
|---|---|
| Column 4, Line 36<br>CLAIM 1 | After "support" cancel "apparatus"; |
| Column 4, Line 42<br>CLAIM 1 | After "correspondingly" cancel "accomodate" and substitute therefore --- accommodate ---; |
| Column 4, Line 53<br>CLAIM 2 | After "to" cancel "accomodate" and substitute therefore --- accommodate ---. |

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*